US011634961B2

(12) United States Patent
Xue et al.

(10) Patent No.: US 11,634,961 B2
(45) Date of Patent: Apr. 25, 2023

(54) METAL-BASED DISSOLVABLE BALL SEAT, SETTING SYSTEM AND SETTING METHOD

(71) Applicant: PetroChina Company Limited, Beijing (CN)

(72) Inventors: Xiaowei Xue, Beijing (CN); Jianguo Yao, Beijing (CN); Zhiguo Wang, Beijing (CN); Guofu Ren, Beijing (CN); Xiangjun Hu, Beijing (CN); Siwen Guo, Beijing (CN); Minqi Zhao, Beijing (CN); Changqing Feng, Beijing (CN); Kai Li, Beijing (CN); Penggang Huang, Beijing (CN)

(73) Assignee: PetroChina Company Limited, Beijing (CN)

( * ) Notice: Subject to any disclaimer, the term of this patent is extended or adjusted under 35 U.S.C. 154(b) by 139 days.

(21) Appl. No.: 17/039,909

(22) Filed: Sep. 30, 2020

(65) Prior Publication Data

US 2021/0277741 A1 Sep. 9, 2021

(30) Foreign Application Priority Data

Mar. 3, 2020 (CN) ..... 202010138227.8

(51) Int. Cl.
*E21B 23/01* (2006.01)
*E21B 33/12* (2006.01)
(Continued)

(52) U.S. Cl.
CPC ..... *E21B 33/1208* (2013.01); *E21B 23/01* (2013.01); *E21B 23/06* (2013.01); *E21B 33/1293* (2013.01); *E21B 2200/08* (2020.05)

(58) Field of Classification Search
CPC ..... E21B 2200/08; E21B 23/01; E21B 23/06; E21B 33/1208; E21B 33/1293
See application file for complete search history.

(56) References Cited

U.S. PATENT DOCUMENTS 2,678,101 A * 5/1954 Thaxton ..... E21B 23/06 166/134
4,716,964 A 1/1988 Erbstoesser et al.
(Continued)

FOREIGN PATENT DOCUMENTS

CN 201705281 U 1/2011
CN 102011560 A 4/2011
(Continued)

OTHER PUBLICATIONS

Chinese Search Report for Chinese Application No. 202010138227.8, entitled "Metal-Based Dissolvable Ball Seat, Setting System and Setting Method," dated Feb. 2, 2020.
(Continued)

*Primary Examiner* — D. Andrews
*Assistant Examiner* — Ronald R Runyan
(74) *Attorney, Agent, or Firm* — Hamilton, Brook, Smith & Reynolds, P.C.

(57) ABSTRACT

A metal-based dissolvable ball seat comprises a mandrel, a tail base, a sliding body, a slip and a sealing ring. The mandrel can be disengaged from the tail base under predefined shearing force. The sliding body is disposed to sleeve the mandrel and located above the tail base; the slip is disposed outside the mandrel and slidably abutted against the tail base and the sliding body respectively; the slip and the sliding body are slidably abutted against each other through a first conical surface structure, and/or the slip and the tail base are slidably abutted against each other through a second conical surface structure; the sealing ring is movable along axial direction of the mandrel together with the slip; when the sliding body and the tail base are approaching each other, the slip opens up and the sealing ring expands outward. A setting system and a setting method are provided.

36 Claims, 10 Drawing Sheets

(51) Int. Cl.
*E21B 23/06* (2006.01)
*E21B 33/129* (2006.01)

(56) References Cited

U.S. PATENT DOCUMENTS

| | | | | |
|---|---|---|---|---|
| 2011/0259610 | A1* | 10/2011 | Shkurti | E21B 33/12 166/318 |
| 2013/0186616 | A1* | 7/2013 | Xu | E21B 33/129 166/212 |
| 2016/0376869 | A1* | 12/2016 | Rochen | E21B 43/261 166/135 |
| 2018/0030807 | A1* | 2/2018 | Martin | E21B 33/1208 |
| 2019/0011191 | A1 | 1/2019 | Steinbauer et al. | |
| 2020/0080394 | A1* | 3/2020 | Slup | E21B 23/04 |
| 2020/0277831 | A1* | 9/2020 | Kellner | E21B 33/1293 |

FOREIGN PATENT DOCUMENTS

| | | | |
|---|---|---|---|
| CN | 105971578 | A | 9/2016 |
| CN | 206158668 | U | 5/2017 |
| CN | 108166965 | A | 6/2018 |
| CN | 207538816 | U | 6/2018 |
| CN | 108412475 | A | 8/2018 |
| CN | 109138918 | A | 1/2019 |
| CN | 109252845 | A | 1/2019 |
| CN | 109577910 | A | 4/2019 |
| CN | 109812243 | A | 5/2019 |
| CN | 209724296 | U | 12/2019 |

OTHER PUBLICATIONS

Chinese Search Report for counterpart Application No. 202010138227.8, dated Oct. 28, 2022.

* cited by examiner

METAL-BASED DISSOLVABLE BALL SEAT, SETTING SYSTEM AND SETTING METHOD

RELATED APPLICATION(S)

This application claims priority under 35 U.S.C. § 119 or 365 to China, Application No. 202010138227.8, filed Mar. 3, 2020. The entire teachings of the above application(s) are incorporated herein by reference.

BACKGROUND

The present disclosure relates to the technical field of oil and gas field developments, and, in particular, to a metal-based dissolvable ball seat, a setting system, and a setting method.

In the volumetric fracturing technology for horizontal wells, it is an important operation to conduct a segmented packing of the oil well casing. The main tools for the segmented packing include dissolvable bridge plug and dissolvable locating ball seat. In fracturing with the dissolvable bridge plug, the operation cycle is significantly shortened. However, in the field, rubber that is not completely degraded often presents in the returned residues, which impairs cleanliness of the wellbore. In addition, there is a risk that the rubber cannot be completely dissolved after fracturing of a long horizontal section, which leads to blockage of the wellbore. For the dissolvable locating ball seat, a matched working barrel should be attached to the casing in advance, which limits the flexibility of upgrading. In addition, a wellbore shrinkage is involved, which is disadvantageous for later upgrading and leads to the risk of jamming.

SUMMARY

An objective of the present disclosure is to provide a metal-based dissolvable ball seat, a setting system and a setting method, so as to eliminate the necessity of attaching a matched working barrel in advance.

The above objective of the present disclosure can be achieved by adopting the following technical solutions.

The present disclosure provides a metal-based dissolvable ball seat, comprising: a mandrel, a tail base, a sliding body, a slip and a sealing ring, wherein the tail base is coupled to a lower end of the mandrel so that the mandrel can be disengaged from the tail base under a predefined shearing force; the sliding body is disposed to sleeve the mandrel and located above the tail base; the slip is disposed outside the mandrel and between the tail base and the sliding body, and the slip is slidably abutted against the tail base and the sliding body respectively; the slip and the sliding body are slidably abutted against each other through a first conical surface structure, and/or the slip and the tail base are slidably abutted against each other through a second conical surface structure; the sealing ring is coupled to the slip, and is able to move along an axial direction of the mandrel together with the slip; the metal-based dissolvable ball seat is configured so that when the sliding body and the tail base are approaching each other, the slip is opened up and the sealing ring is expanded outward, and when the sliding body and the tail base are close to each other to a predefined position, the sliding body and the slip are locked to each other.

In a preferred embodiment, a substrate of the slip, the sliding body and the tail base are all made of dissolvable metal materials.

In a preferred embodiment, the first conical surface structure comprises a first outer conical surface provided on the sliding body and a first inner conical surface provided on the slip and matching with the first outer conical surface, the first outer conical surface is tapered from top to bottom.

In a preferred embodiment, the first outer conical surface is a circular conical surface.

In a preferred embodiment, a taper angle of the first outer conical surface is in a range from 3° to 7°.

In a preferred embodiment, the taper angle of the first outer conical surface is one of 3°, 3.5°, 4°, 4.9°, 5°, 5.1°, 6°, 6.4° or 7°.

In a preferred embodiment, the slip and the tail base are slidably abutted against each other through a guide groove structure, which comprises a guide groove provided on the tail base and extended from inside to outside and a guide protrusion provided on the slip and matching with the guide groove.

In a preferred embodiment, the guide groove extends in a radial direction of the mandrel.

In a preferred embodiment, a cross section of the guide groove is rectangular.

In a preferred embodiment, the sealing ring is disposed above the slip, and the sealing ring is provided with a second inner conical surface matching with the first outer conical surface.

In a preferred embodiment, the sealing ring is made of a dissolvable metal material.

In a preferred embodiment, the sealing ring is made of a magnesium-aluminum alloy or a lithium-magnesium alloy.

In a preferred embodiment, dissolution rates of the tail base, the sliding body, a substrate of the slip and the sealing ring descend in sequence.

In a preferred embodiment, the slip comprises a plurality of slip petals distributed circumferentially around an axis of the mandrel.

In a preferred embodiment, each of the slip petals comprises a substrate, and a slip block fixed to the substrate for engaging with a wellbore.

In a preferred embodiment, the number of the slip petals is in a range from 6 to 8.

In a preferred embodiment, the slip comprises at least one hoop hooping the slip petals.

In a preferred embodiment, at least one columnar pin is provided on the slip petal, a columnar hole matching with the columnar pin is provided on the sealing ring, and the columnar pin is accommodated in the columnar hole.

In a preferred embodiment, the tail base is in threaded connection with the mandrel.

In a preferred embodiment, a lower end of the sliding body is provided with a sliding body horse-tooth buckle, and the tail base is provided with a tail base horse-tooth buckle matching with the sliding body horse-tooth buckle to lock the sliding body and the tail base.

In a preferred embodiment, an upper portion of the sliding body is provided with a cylindrical portion.

In a preferred embodiment, when the metal-based dissolvable ball seat is placed into a well, a maximum outer diameter of the sliding body is larger than that of the sealing ring, and/or a maximum outer diameter of the tail base is larger than that of the sealing ring.

In a preferred embodiment, an upper portion of the sliding body is provided with a ball seat hole, which is a conical ball seat hole tapered from top to bottom.

In a preferred embodiment, an upper portion of the sliding body is provided with a ball seat hole, which is a spherical crown-shaped ball seat hole.

In a preferred embodiment, the sliding body is provided with a plurality of first through holes.

In a preferred embodiment, a diameter of the first through hole is in a range from 5 mm to 10 mm.

In a preferred embodiment, the tail base is provided with a plurality of second through holes.

In a preferred embodiment, a diameter of the second through hole is in a range from 5 mm to 10 mm.

In a preferred embodiment, the second conical surface structure comprises a second outer conical surface provided on the tail base, and a third inner conical surface provided on the slip and matching with the second outer conical surface, the second outer conical surface being gradually expanding from top to bottom.

In a preferred embodiment, the second outer conical surface is a circular conical surface, and a taper angle of the second outer conical surface is in a range from 3° to 7°.

In a preferred embodiment, a top surface of the sliding body is provided with an annular boss.

The present disclosure provides a setting system, comprising: a setting tool and the metal-based dissolvable ball seat described above; the setting tool comprises a setting tool outer barrel abutted against an upper end of a sliding body in the metal-based dissolvable ball seat, and a setting tool push rod connected to an upper end of a mandrel in the metal-based dissolvable ball seat, wherein the setting tool outer barrel is configured to apply a downward pushing force to the sliding body, and the setting tool push rod is configured to apply an upward pulling force to the mandrel.

In a preferred embodiment, the setting system further comprises an extrusion sleeve which is disposed between the setting tool outer barrel and the sliding body, and which has an upper end in threaded connection with the setting tool outer barrel and a lower end abutted against an upper end face of the sliding body.

In a preferred embodiment, the setting system further comprises an adapter which is disposed in the extrusion sleeve, and which has a lower end in threaded connection with an upper end of the mandrel and an upper end in threaded connection with the setting tool push rod.

The present disclosure provides a setting method working with the metal-based dissolvable ball seat described above, comprising:

S100, driving the sliding body to approach the tail base, so that the slip is opened up and the sealing ring is expanded outward by the first conical surface structure and/or the second conical surface structure;

S200, causing the slip to open up to be anchored to an inner wall of a wellbore, causing the sealing ring to expand to form a sealing contact with the inner wall of the wellbore, and causing the sliding body and the slip to be locked to each other;

S300, causing the mandrel to be disengaged from the tail base under an upward pulling force and lifted out of the wellbore; and S400, putting a dissolvable ball into the wellbore, and causing the dissolvable ball to move to form a sealing fit with an upper portion of the sliding body.

In a preferred embodiment, a lower end of the sliding body is provided with a sliding body horse-tooth buckle, and the tail base is provided with a tail base horse-tooth buckle matching with the sliding body horse-tooth buckle to lock the sliding body and the tail base; and in step S200, the sliding body and the tail base are locked by engaging the sliding body horse-tooth buckle and the tail base horse-tooth buckle, so as to lock the sliding body and the slip to each other.

In a preferred embodiment, the slip and the sliding body are slidably abutted against each other through a first conical surface structure, which comprises a first outer conical surface provided on the sliding body, and a first inner conical surface provided on the slip and matching with the first outer conical surface, the first outer conical surface being tapered from top to bottom; a taper angle of the first outer conical surface is in a range from 3° to 7°; and in step S200, the sliding body and the slip are locked to each other by a friction force between the first outer conical surface and the first inner conical surface.

In a preferred embodiment, the tail base is in threaded connection with the mandrel; and in step S300, the mandrel is disengaged from the tail base by breaking a threaded connection structure between the tail base and the mandrel.

The present disclosure has the following characteristics and advantages.

After the metal-based dissolvable ball seat is delivered to the designed position in the wellbore, the mandrel and the tail base are fixed relative to each other because they are connected together. With the relative movement between the sliding body and the tail base, the slip is driven to open up to be anchored to an inner wall of the wellbore. At the same time, the sealing ring expands outward to abut against the inner wall of the wellbore to form a sealing fit. When the sliding body and the tail base are close to each other to a predefined position, the sliding body and the slip are locked to complete the setting.

A pulling force on the mandrel is increased to reach a predefined shearing force, so that the mandrel is disengaged from the tail base. Then, a dissolvable ball can be put into the wellbore to be in sealing fit with an inner wall of the sliding body, thereby completing the segmented packing of the wellbore. After the fracturing, the dissolvable ball and metal-based dissolvable ball seat are dissolved gradually, resulting in a full-bore.

The setting position of the metal-based dissolvable ball seat in the wellbore is more flexible, without the need to place the matched working barrel in advance, and the wellbore is not subjected to shrinkage or enlargement, which is advantageous for later operation, and advantageous for achieving full-bore and for upgrading towards infinite-stage fracturing.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The technical solutions of the embodiments in the present disclosure will be clearly and comprehensively described in the following with reference to the accompanying drawings. It is apparent that the embodiments as described are merely some, rather than all, of the embodiments of the present disclosure. All other embodiments obtained by those skilled in the art based on one or more embodiments described in the present disclosure without creative efforts should fall within the scope of this disclosure.

Figure 1:
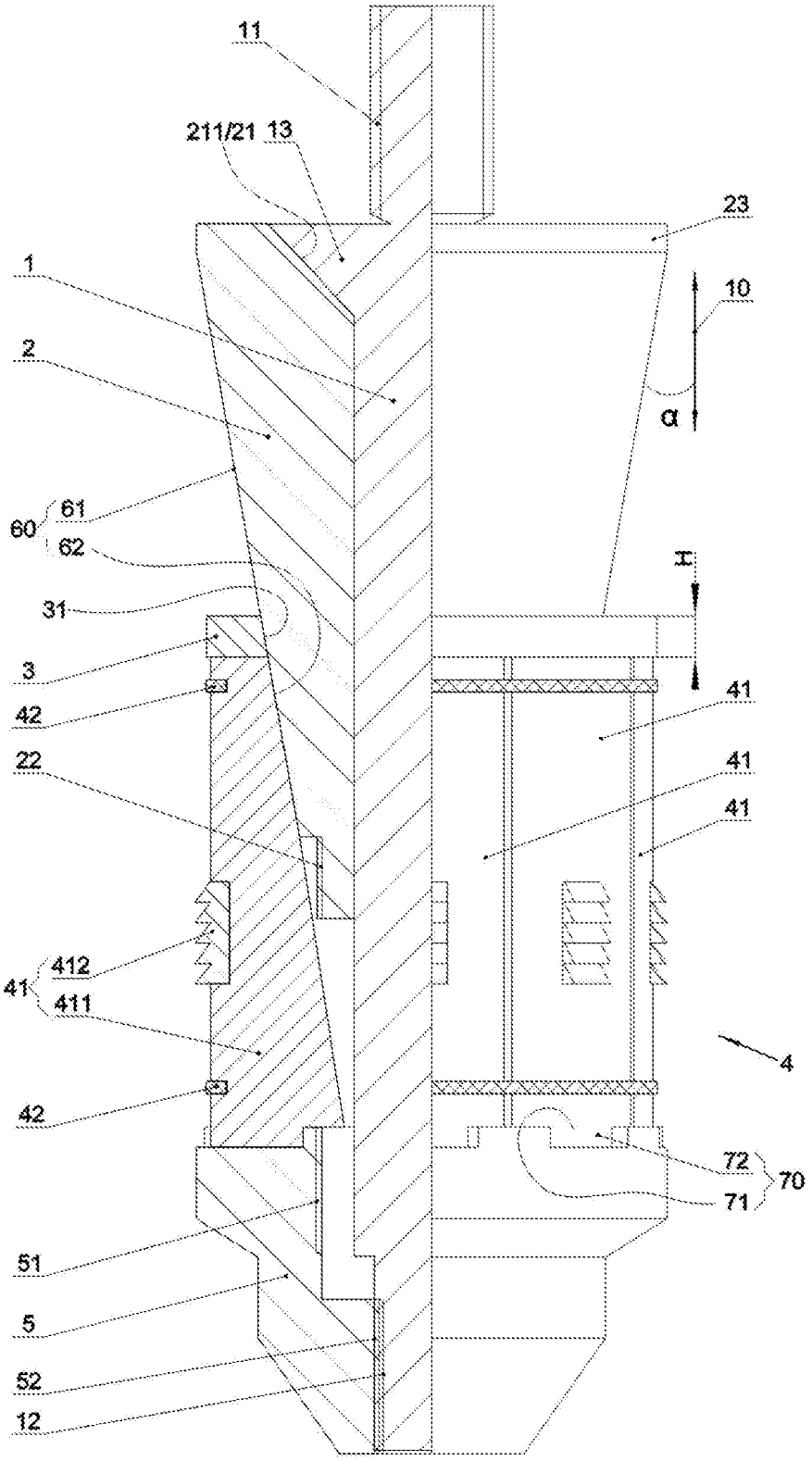
FIG. 1 is a structural schematic diagram of a first embodiment of a metal-based dissolvable ball seat provided by the present disclosure before placement into a well.
Figure 6:
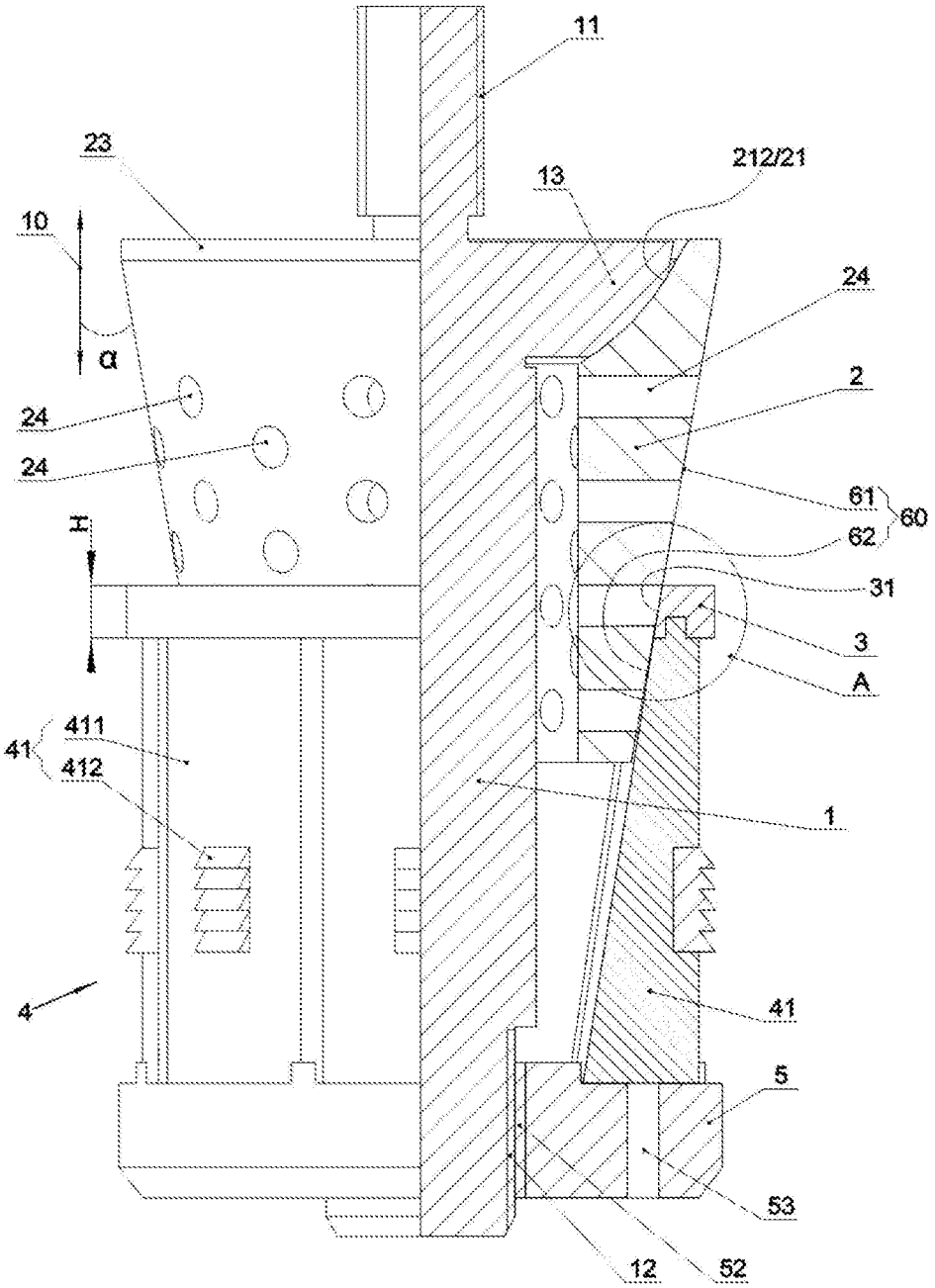
FIG. 6 is a structural schematic diagram of a fourth embodiment of a metal-based dissolvable ball seat provided by the present disclosure before placement into a well.

The present disclosure provides a metal-based dissolvable ball seat as illustrated in FIG. 1 and FIG. 6, comprising: a mandrel 1, a tail base 5, a sliding body 2, a slip 4 and a sealing ring 3. The tail base 5 is coupled to a lower end of the mandrel 1 so that the mandrel 1 can be disengaged from the tail base 5 under a predefined shearing force. The sliding body 2 is disposed to sleeve the mandrel 1, and located above the tail base 5. The slip 4 is disposed outside the mandrel 1, between the tail base 5 and the sliding body 2, and slidably abutted against the tail base 5 and the sliding body 2 respectively. In addition, the slip 4 and the sliding body 2 are slidably abutted against each other through a first conical surface structure 60, and/or the slip 4 and the tail base 5 are slidably abutted against each other through a second conical surface structure 80. The sealing ring 3 is coupled to the slip 4, and is able to move together with the slip 4 along an axial direction 10 of the mandrel. As the sliding body 2 and the tail base 5 move closer to each other, the slip 4 is opened up and the sealing ring 3 is expanded outward. When the sliding body 2 and the tail base 5 are close to each other to a predefined position, the sliding body 2, the slip 4 and the tail base 5 are locked to each other.

The metal-based dissolvable ball seat does not include a rubber sleeve, and the tail base 5, the sliding body 2 and the body of the slip 4 are all made of dissolvable metal so that the dissolution rate is high, which can reduce the generation of lumps and facilitate the operation on long horizontal sections.

After the metal-based dissolvable ball seat is delivered to a designed position in a wellbore, the mandrel 1 and the tail base 5 are fixed relative to each other because they are connected together, the tail base 5 can apply an upward force to the slip 4, and the sliding body 2 can apply a downward force to the slip 4. With the relative movement between the sliding body 2 and the tail base 5, the slip 4 is driven to open up to be anchored to an inner wall of the wellbore. At the same time, the sealing ring 3 expands outward to abut against the inner wall of the wellbore to form a sealing fit. When the sliding body 2 and the tail base 5 are close to each other to a predefined position, the sliding body 2 and the slip 4 are locked to complete the setting. A pulling force on the mandrel 1 is increased to reach a predefined shearing force, so that the mandrel 1 is disengaged from the tail base 5. Then, a dissolvable ball may be put into the wellbore to be in sealing fit with an inner wall of the sliding body 2, thereby completing the segmented packing of the wellbore. After the fracturing, the dissolvable ball and metal-based dissolvable ball seat are dissolved gradually, resulting in a full-bore. The setting position of the metal-based dissolvable ball seat in the wellbore is more flexible, without the need to place the matched working barrel in advance, and the wellbore is not subjected to shrinkage or enlargement, which is advantageous for later operation. Because the setting position of the metal-based dissolvable ball seat in the wellbore is flexible, the selection of the packing position in the wellbore is also flexible, and the number of the layers, the lengths and the distribution of the layers in separate layer fracturing can be set more flexibly, which is advantageous for achieving full-bore and for upgrading towards infinite-stage fracturing.

In utilizing the metal-based dissolvable ball seat, an upper end of the mandrel 1 is connected to the setting tool. After the setting tool is ignited, an upward pulling force is applied to the mandrel 1, and a downward pushing force is applied to the sliding body 2, so that the sliding body 2 and the tail base 5 move relative to each other. When the sliding body 2 and the tail base 5 approach each other along the axial direction 10 of the mandrel, the slip 4 and the sealing ring 3 are applied with outward pushing forces by the first conical surface structure 60 and/or the second conical surface structure 80.

At least one of the first conical surface structure 60 and the second conical surface structure 80 is included in order to apply the outward pushing forces to the slip 4 and the sealing ring 3 when the sliding body 2 and the tail base 5 approach each other.

In the case where the slip 4 and the sliding body 2 are slidably abutted against each other through the first conical surface structure 60, when the sliding body 2 moves downward relative to the slip 4, as illustrated in FIGS. 1 and 6, the sliding body 2 will apply an outward pushing force to the slip 4 and the sealing ring 3 owing to the structural characteristic that the first conical surface structure 60 expands gradually from bottom to top. In this case, the slip 4 and the sliding body 2 are kept in abutment, and both a radial sliding and an axial sliding occur simultaneously between the slip 4 and the sliding body 2.

Figure 5:
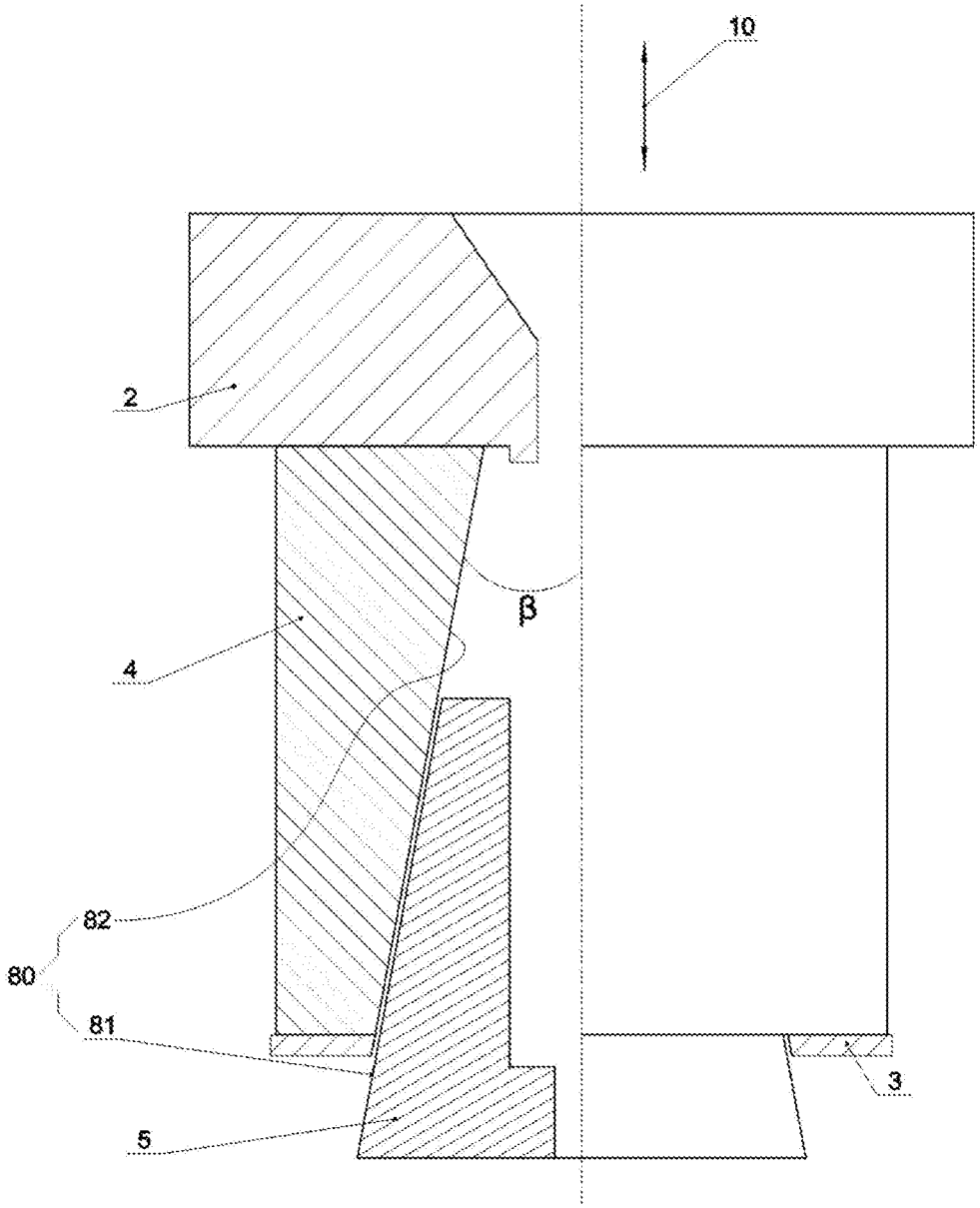
FIG. 5 is a schematic diagram of a sliding body, a slip and a tail base in a third embodiment of a metal-based dissolvable ball seat provided by the present disclosure.

In the case where the slip 4 and the tail base 5 are slidably abutted against each other through the second conical surface structure 80, when the tail base 5 moves upward relative to the slip 4, as illustrated in FIG. 5, the tail base 5 will apply an outward pushing force to the slip 4 and the sealing ring 3 owing to the structural characteristic that the second conical surface structure 80 expands gradually from top to bottom. In this case, the slip 4 and the tail base 5 are kept in abutment, and both a radial sliding and an axial sliding occur simultaneously between the slip 4 and the tail base 5.

Figure 4:
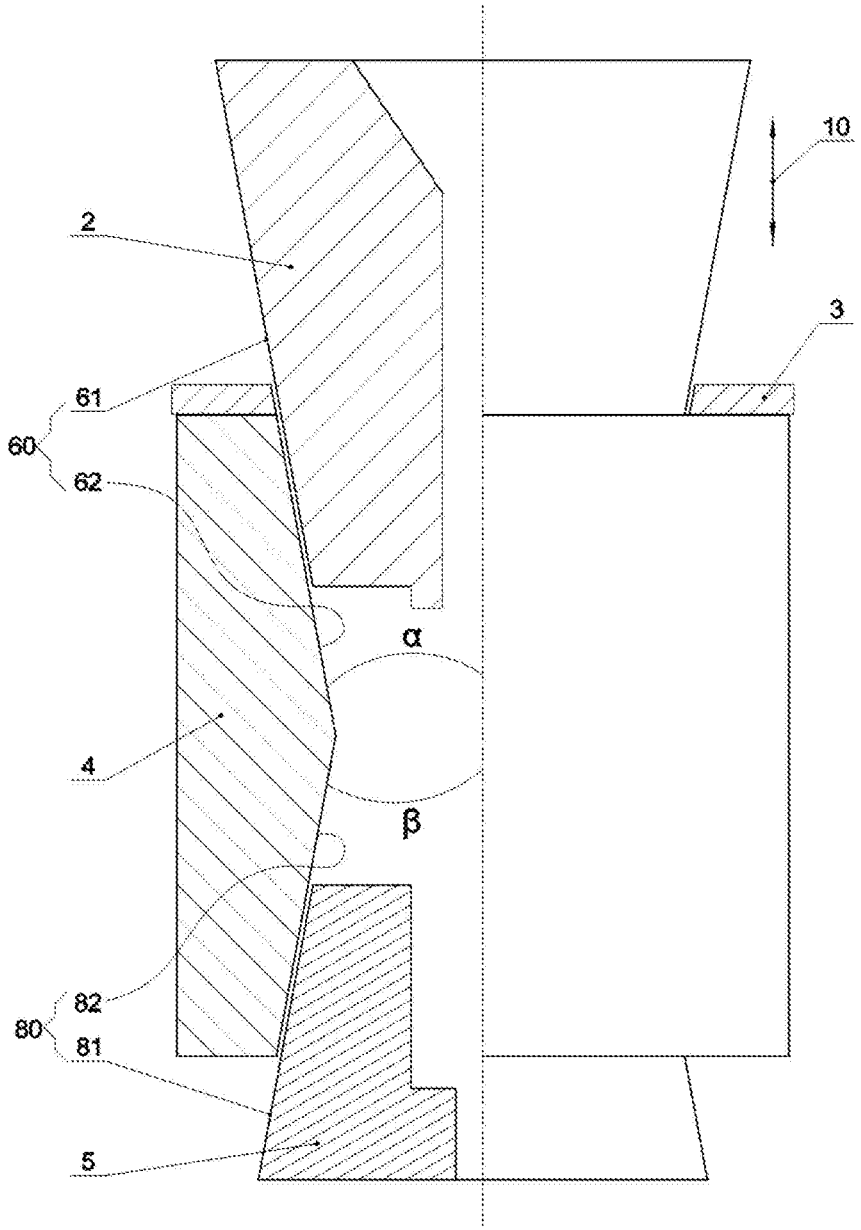
FIG. 4 is a schematic diagram of a sliding body, a slip and a tail base in a second embodiment of a metal-based dissolvable ball seat provided by the present disclosure.

In the case where the slip 4 and the sliding body 2 are slidably abutted against each other through the first conical surface structure 60, and the slip 4 and the tail base 5 are slidably abutted against each other through the second conical surface structure 80, when the sliding body 2 and the tail base 5 approach each other, as illustrated in FIG. 4, the sliding body 2 will apply an outward pushing force to the slip 4 and the sealing ring 3, and the tail base 5 will also apply an outward pushing force to the slip 4 and the sealing ring 3. In this case, both a radial sliding and an axial sliding occur simultaneously between the slip 4 and the sliding body 2, while both a radial sliding and an axial sliding occur simultaneously between the slip 4 and the tail base 5.

Referring to FIGS. 1 and 6, the first conical surface structure 60 comprises a first outer conical surface 61 provided on the sliding body 2, and a first inner conical surface 62 provided on the slip 4 and matching with the first outer conical surface 61, and both the first outer conical surface 61 and the first inner conical surface 62 are tapered from top to bottom. In order to generate the outward pushing force, the first outer conical surface 61 may be a pyramid surface or a circular conical surface. Preferably, as illustrated in FIGS. 1 and 6, the sliding body 2 is circular cone-shaped as a whole, and the first outer conical surface 61 is a circular conical surface.

As illustrated in FIGS. 1 and 6, the sealing ring 3 may be disposed above the slip 4, and provided with a second inner conical surface 31 matching with the first outer conical surface 61. When moving upward relative to the sliding body 2, the slip 4 pushes the sealing ring 3 to move upward together, so that the sealing ring 3 gradually expands due to the first outer conical surface 61. Specifically, the sealing ring 3 is ring-shaped, and the second inner conical surface 31 and the first outer conical surface 61 are circular conical surfaces with the same taper.

Further, the sealing ring 3 is made of a dissolvable metal material with a high ductility, and when the outer wall of the sealing ring 3 is abutted against the inner wall of the wellbore, a metal sealing is formed, which is beneficial in ensuring an excellent sealing. In addition, the sealing ring 3 can be dissolved quickly after the fracturing, thus reducing the generation of lumps. Specifically, the sealing ring 3 may be made of magnesium-aluminum alloy or lithium-magnesium alloy. Preferably, an axial thickness H of the sealing ring 3 meets: 8 mm≤H≤15 mm.

Further, according to the actual operation conditions, dissolvable metal materials with different dissolution rates may be selected for different components, e.g., the dissolution rates of the tail base 5, the sliding body 2, a substrate 411 of the slip 4 and the sealing ring 3 may descend in sequence. Usually, the purpose of the dissolvable ball seat is to ensure that the fracturing can bear a high pressure, and after the fracturing operation, the dissolvable ball seat can be quickly dissolved with a high efficiency, thereby improving the operation efficiency and shortening the wellbore treatment period after the fracturing operation. According to the actual operation conditions and the characteristics of each component of the tool, the inventor specifies the tail base 5, which is not for pressure bearing but mainly for achieving a setting movement, to dissolve most quickly to ensure an instant dissolution after the setting. For the sliding body 2, the substrate and the sealing ring 3 which bear a high pressure, according to their respective volumes and pressure-bearing characteristics, the sliding body 2 and the substrate 411, which are larger in volume, are specified to be dissolved quickly, while the sealing ring 3, which is smaller in volume and acts as the main pressure-bearing component, is specified to be dissolved slowly, thereby ensuring that the whole dissolvable ball seat can be dissolved efficiently on the premise of ensuring the pressure-bearing.

The self-weight of the sliding body 2 will produce a downward force, in addition, in the process of placing the ball seat into the wellbore, there is a risk that sliding body 2 and mandrel 1 might be disengaged due to a unknown force such as a collision with other structure in the wellbore, which leads to a relative approaching movement between the sliding body 2 and the tail base 5 prematurely. In order to avoid the premature disengagement between the sliding body 2 and mandrel 1, a shear pin may be provided between the sliding body 2 and the mandrel 1. The shear pin is provided along a radial direction of the mandrel 1 to pass through the sliding body 2 and is connected to the mandrel 1, so that by means of the shear pin, the sliding body 2 and the mandrel 1 can be prevented from being disengaged from each other when being placed into the well. After the metal-based dissolvable ball seat is placed to the designed position in the wellbore, an upward pulling force is applied to the mandrel 1 and a downward pushing force is applied to the sliding body 2 by the setting tool, so that the shear pin is sheared off, the sliding body 2 is disengaged from the mandrel 1, and moves downward by the setting tool.

By providing the shear pin between sliding body 2 and mandrel 1, the problem of the premature disengagement between the sliding body 2 and the mandrel 1 can be alleviated. However, it is difficult to accurately control the disengagement between the sliding body 2 and the mandrel 1. On one hand, the shear pin is usually assembled manually, thus there may be an error of improper tightness. If the shearing force of the shear pin is improperly set or the machining accuracy of the shear pin is not enough, the shear pin may not be sheared off under the designed condition, resulting in a difficult disengagement or a premature disengagement between the sliding body 2 and the mandrel 1, and the overall operation of the tool may fail. On the other hand, after the metal-based dissolvable ball seat is set, the mandrel 1 needs to be disengaged from the tail base 5 under the predefined shearing force, that is, the disengagement between the sliding body 2 and the mandrel 1 and the disengagement between the tail base 5 and the mandrel 1 should be carried out step by step, and the disengagement between the sliding body 2 and the mandrel 1 comes first, i.e., there is a timing requirement for those disengagements, which greatly increases the difficulty in control, increases the implementation difficulty of providing the shear pin between the sliding body 2 and the mandrel 1, and reduces the operation reliability.

For this reason, the inventor has improved the first conical surface structure 60. As illustrated in FIGS. 1 and 6, a taper angle of the first outer conical surface 61 is denoted as a, which meets 3°≤α≤7°, for example, α=3°, α=3.5°, α=4°, α=4.9°, α=5°, α=6°, α=6.4° or α=7°. The first outer conical surface 61 is attached to the first inner conical surface 62, and also attached to the second inner conical surface 31. A static friction force exists between the sliding body 2 and the slip 4, and between the sealing ring 3 and the sliding body 2, respectively. By setting 3°≤α≤7°, a self-locking formed under the static friction force can prevent the slip 4 from sliding along the sliding body 2, thereby effectively alleviating the problem of the premature disengagement between the sliding body 2 and the mandrel 1 as well as the premature relative approaching movement between the sliding body 2 and the tail base 5. According to this embodiment, the slip 4 and the sealing ring 3 are matching with the sliding body 2, so that the shear pin between the sliding body 2 and the mandrel 1 can be omitted, thereby reducing the difficulty in control and improving the operation reliability.

In the case where the slip 4 and the sliding body 2 are slidably abutted against each other through the first conical surface structure 60, the slip 4 and the tail base 5 may be slidably abutted against each other through the second conical surface structure 80. However, in order to further improve the operation stability of the metal-based dissolvable ball seat, the inventor proposes another embodiment of the structure of slidable abutment between the slip 4 and the tail base 5: the inner wall of the slip 4 is generally tapered from top to bottom, and the slip 4 and the tail base 5 are slidably abutted against each other through a guide groove structure 70, which comprises a guide groove 71 provided in the tail base 5 and extending from inside to outside, and a guide protrusion 72 provided on the slip 4 and matching with the guide groove 71. The guide groove structure 70 guides the slip 4 to slide relative to the tail base 5.

Further, the guide groove 71 extends along the radial direction of the mandrel 1, the slip 4 and the tail base 5 are kept in abutment through the guide groove structure 70, and the slip can slide along the radial direction of the mandrel 1 relative to the tail base. The movement of the slip 4 along the radial direction of the mandrel 1 relative to the tail base 5 avoids the slip 4 moving along the axial direction 10 of the mandrel relative to the tail base 5. In this way, in the setting process, the sliding body 2 moves downward relative to the tail base 5 to drive the slip 4 to expand outward. In this process, there is a climbing movement between the slip 4 and the sliding body 2, while there is no climbing movement between the slip 4 and the tail base 5, that is, the climbing movement is reduced and constraint on the outward expansion of the slip 4 is alleviated. It is therefore advantageous in avoiding that the slip 4 fails to be put in place due to failure in the climbing movement, and the operation stability of the metal-based dissolvable ball seat is improved, making the metal-based dissolvable ball seat excellent in adaptability to various processes and in techno-economic efficiency.

The cross section of the guide groove 71 can be of various shapes, e.g., semicircular, trapezoidal or rectangular. Preferably, the cross section of the guide groove 71 is rectangular.

The slip 4 is for anchoring to the wellbore under a force from inside to outside. The slip 4 may adopt an integral structure, and provided with a plurality of axial grooves circumferentially distributed. Under the force from inside to outside, the integral type slip breaks at the axial grooves and separates into a plurality of blocks, each moving outward to be anchored to the wellbore. The integral type slip has higher requirements on the depth and length of the grooves, and the breaking force needs to be accurately controlled.

The slip 4 can also adopt a split structure, as illustrated in FIGS. 1, 3, 6 and 8. The split type slip 4 comprises a plurality of slip petals 41 distributed circumferentially around an axis of the mandrel 1, each matching with the sliding body 2 and the tail base 5, respectively, and moving outward when subjected to an outward force. The split type slip 4 has a simpler structure and a higher operation stability. Preferably, the metal-based dissolvable ball seat adopts the split type slip 4.

Further, the slip petal 41 comprises a substrate 411, and a slip block 412 for anchoring to the inner wall of the wellbore. The slip block 412 is fixed to the substrate 411 which is made of dissolvable metal. Preferably, the slip block 412 has 5 to 6 teeth thereon. More preferably, the teeth are ceramic teeth so as to have a higher strength and be anchored to the wellbore more firmly. The number of the slip petals 41 may be in a range from 6 to 8. Before being placed into the well, a spacing between two adjacent slip petals 41 may be 1 mm to 2 mm.

Figure 2:
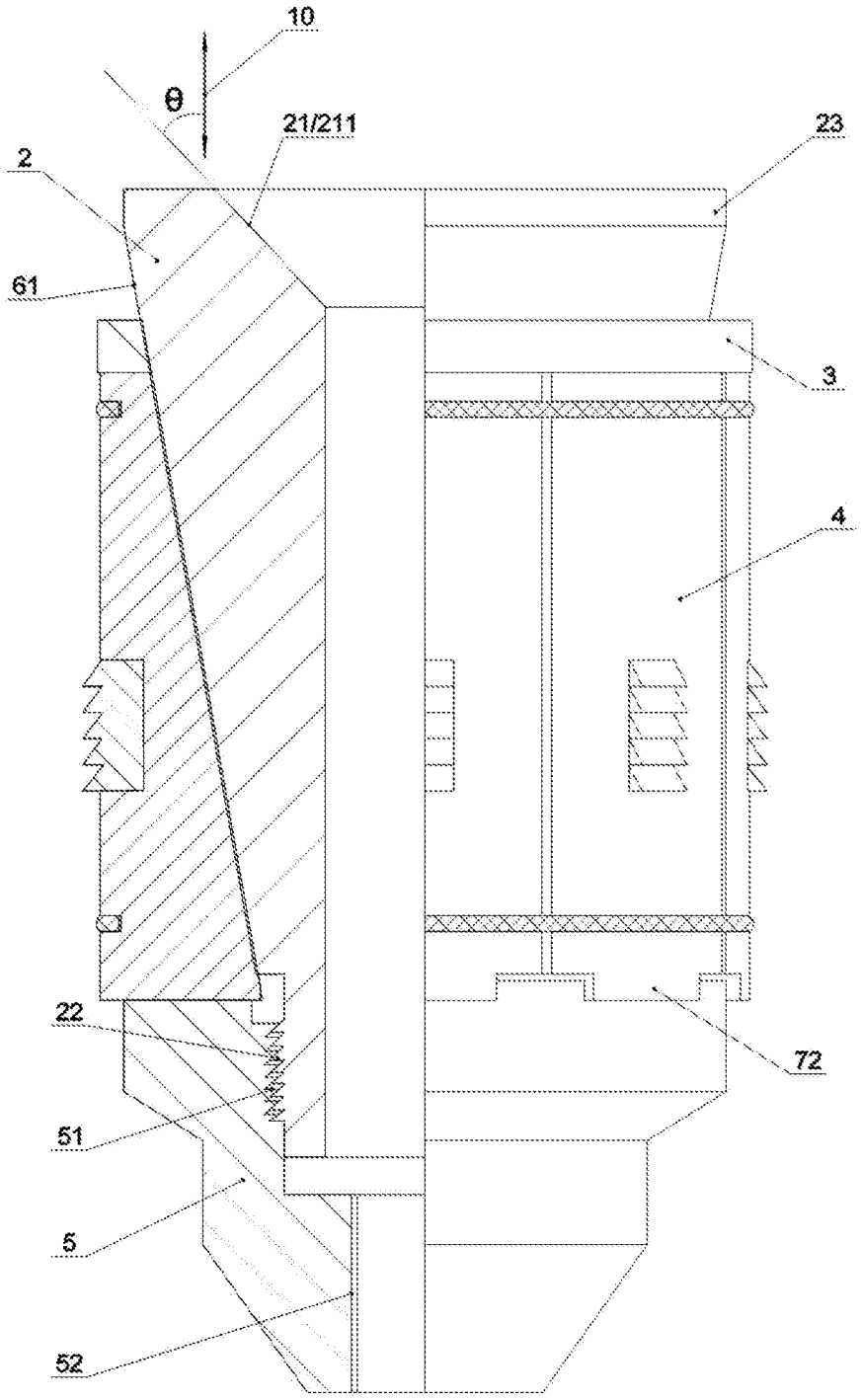
FIG. 2 is a structural schematic diagram of a metal-based dissolvable ball seat illustrated in FIG. 1 after being set.
Figure 3:
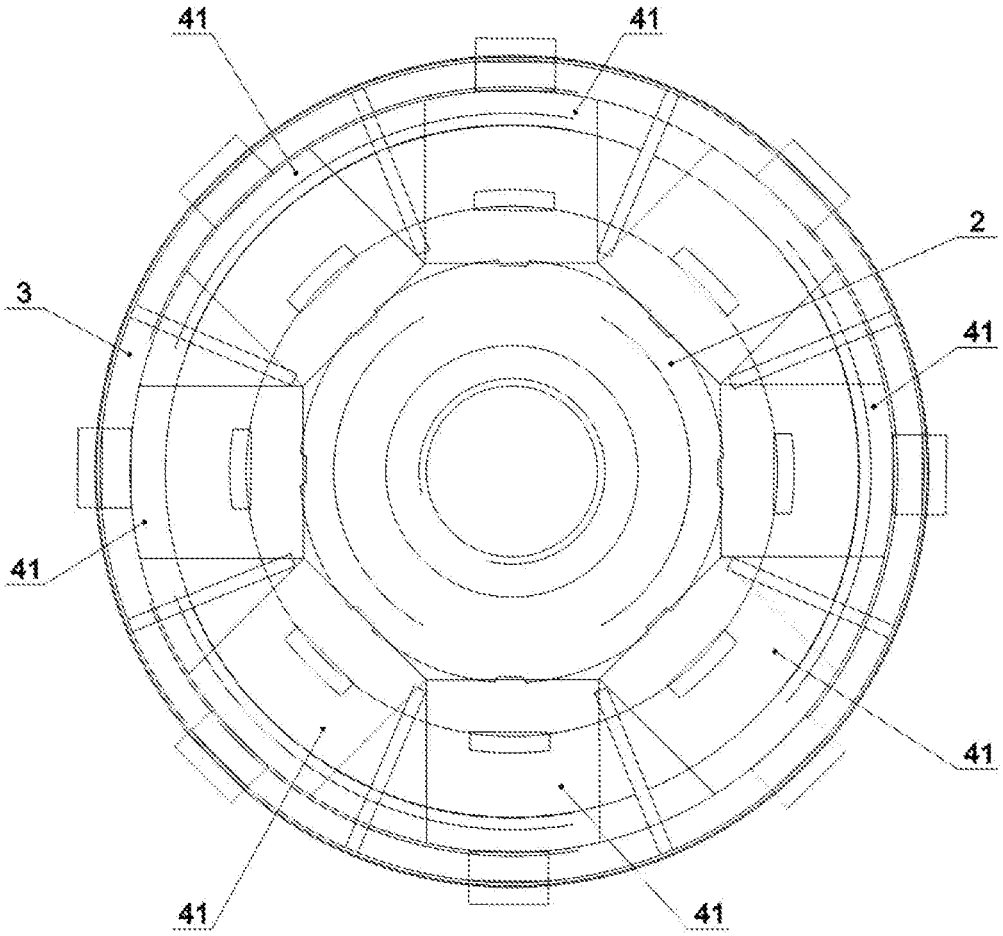
FIG. 3 is a top view of FIG. 2.

In order to avoid loosening of the slip petals 41 when being placed into the well, the slip 4 may comprise at least one hoop 42 hooping the slip petals 41. In some embodiments, as illustrated in FIGS. 1 and 2, the slip 4 may comprise two hoops 42, which are close to upper and lower ends of the slip petals 41, respectively. Preferably, the hoop 42 is made of dissolvable rubber, which has great elasticity, so as to avoid any breaking during the outward expansion, and help to uniformly open up the slip petals 41 outward. The hoop 42 may have an axial thickness of 2 mm.

Figure 7:
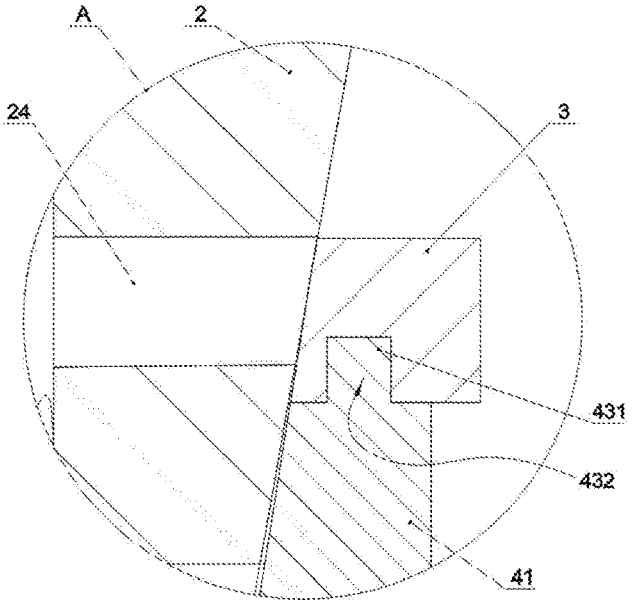
FIG. 7 is a partial enlarged view at A in FIG. 6.

In other embodiments, as illustrated in FIGS. 6 and 7, at least one columnar pin 431 is provided on the slip petal 41, and a columnar hole 432 matching with the columnar pin 431 is provided on the sealing ring 3. The columnar pin 431 is accommodated in the columnar hole 432, and through the coupling between the columnar pin 431 and the columnar hole 432, the slip petals 41 are constrained in placing the metal-based dissolvable ball seat into the well, so as to prevent the loosening of the slip petals 41. When the slip petals 41 is opened up, the columnar pin 431 can be sheared off. By providing the columnar pin 431 and the columnar hole 432, the hoop 42 can be omitted, therefore the use of rubber is reduced, and complete dissolubility can be achieved. In addition, the shearing force can be set beforehand by setting the size and number of the columnar pins 431, therefore the shearing force when opening up the slip petals 41 is controllable. By contrast, in the case that the hoop 42 made of rubber is utilized and placed in a recess, the elastic force is uncontrollable, and if the tool is subjected to impact or abrasion, the hoop 42 is prone to fall off, causing the slips 4 to fall apart. Preferably, the columnar pin 431 is a cylindrical pin, with an axis parallel to the axial direction 10 of the mandrel.

The slip 4 in the metal-based dissolvable ball seat has a single-slip structure, which is advantageous in shortening the whole length of the metal-based dissolvable ball seat and more reliably placing the metal-based dissolvable ball seat into the horizontal well, as compared with the double-slip structure having two slip mechanisms disposed along the axial direction of the ball seat.

As illustrated in FIG. 1, an upper portion of the sliding body 2 is provided with a sliding body cylindrical portion 23, which is advantageous in enabling the metal-based dissolvable ball seat to move smoothly in the wellbore to be placed into the wellbore.

In placing the metal-based dissolvable ball seat into the well, the top of the sliding body 2 is abutted against the mandrel 1, the slip 4 is abutted against the sliding body 2, and the relative positions of the sliding body 2, the mandrel 1, the slip 4 and the sealing ring 3 are kept fixed. In this state, a maximum outer diameter of the sliding body 2 is larger than the outer diameter of the sealing ring 3, and/or a maximum outer diameter of tail base 5 is larger than the outer diameter of the sealing ring 3, so as to reduce the abrasion of the sealing ring 3 in the process of placement into the well. Specifically, an outer diameter of the sliding body cylindrical portion 23 of the sliding body 2 may be 2 mm to 3 mm larger than that of the sealing ring 3, or an outer diameter of a tail base cylindrical portion of the tail base 5 may be 2 mm to 3 mm larger than that of the sealing ring 3.

In order to allow the mandrel 1 to be disengaged from the tail base 5 under a predefined shearing force, the tail base 5 is in threaded connection with the mandrel 1, and a strength of the threaded connection determines the magnitude of the shearing force. When the force applied to the tail base 5 by the mandrel 1 increases to the predefined shearing force, the threaded connection structure can be broken by shearing, so that the mandrel 1 is disengaged from the tail base 5, and the constraint between the tail base 5 and the mandrel 1 are removed, resulting in a relative movement and achieving the release of the mandrel 1 and the tail base 5. An appropriate shearing force can be set by setting a thread pitch or the number of threads of the threaded connection structure. Specifically, the threaded connection structure comprises a tail base thread 52 provided on the tail base 5 and a mandrel lower thread 12 provided on the lower end of the mandrel 1, and the tail base thread 52 is engaged with the mandrel lower thread 12. By using the threaded connection structure, it is simple to achieve shearing and the setting is more reliable.

In order that the sliding body 2, the slip 4 and the tail base 5 are locked to each other when the sliding body 2 and tail base 5 are close to each other to a predefined position, in one embodiment of the present disclosure, the lower end of the sliding body 2 is provided with a sliding body horse-tooth buckle 22, and the tail base 5 is provided with a tail base horse-tooth buckle 51 which is matching with the sliding body horse-tooth buckle 22. As illustrated in FIGS. 1 and 2, the sliding body 2 moves downward relative to the tail base 5 until the sliding body horse-tooth buckle 22 and the tail base horse-tooth buckle 51 are buckled together, which indicates the predefined position is reached. With the locking between the sliding body 2 and the tail base 5, the sliding body 2, the slip 4 and tail base 5 are locked together and the slip 4 is kept in an outward expanding state.

The upper end of the mandrel 1 is provided with a mandrel upper thread 11 for threaded connection with a setting tool. The sliding body 2 has a hollow structure with an axis coincided with the axis of the mandrel 1. The upper portion of the sliding body 2 is provided with a ball seat hole 21, through which the mandrel 1 passes, and a variable-diameter shoulder 13 of the mandrel 1 is abutted against the inner wall of the ball seat hole 21 for positioning, and preventing the sliding body 2 from sliding upward along the mandrel 1 when going down the well. After the setting, the mandrel 1 is taken out of the sliding body 2 with the setting tool, and the ball seat hole 21 receives the dissolvable ball which is abutted against the inner wall of the ball seat hole 21 to form a sealing. In some embodiments, as illustrated in FIGS. 1 and 2, the ball seat hole 21 is a conical ball seat hole 211 which gradually tapers from top to bottom, and an inner wall of the conical ball seat hole 211 is a circular conical surface. Preferably, a taper angle θ of the conical ball seat hole 211 is 45°. In other embodiments, as illustrated in FIGS. 6 to 9, the ball seat hole 21 is a spherical crown-shaped ball seat hole 212, an inner wall of which is spherical, which is easy to be matching with a dissolvable ball 95, so that the dissolvable ball 95 is in surface contact with the sliding body 2. This configuration is more suitable to seal the dissolvable metal materials as compared with the case of conical surface which involving a point contact, and can ensure that the dissolvable ball 95 and the sliding body 2 remain to be sealed under a high pressure while being dissolved in the fracturing operation, so as to avoid the case that the dissolvable ball slips off the ball seat hole 21 as its volume shrinks and becomes uneven with the dissolution proceeds. In addition, the volume and weight of the ball seat can be effectively decreased and dissolution residues can be reduced.

In one embodiment of the present disclosure, the sliding body 2 is provided with a plurality of first through holes 24, so that the sliding body 2 has a porous structure, which has the following effects: firstly, decreasing the volume and weight of the ball seat and reducing the dissolution residues; and secondly, increasing the surface area for dissolution, so that the dissolving agent can enter into the ball seat for dissolution, and the dissolution rate is increased. As illustrated in FIG. 6, the first through holes 24 may be disposed along the radial direction of the mandrel 1. Preferably, the diameter of the first through hole 24 is in a range from 5 mm to 10 mm.

In one embodiment of the present disclosure, the tail base 5 is provided with a plurality of second through holes 53, so that the tail base 5 has a porous structure, which has the following effects: firstly, decreasing the volume and weight of the ball seat and reducing the dissolution residues; and secondly, increasing the surface area for dissolution, so that the dissolving agent can enter into the ball seat for dissolution, and the dissolution rate is increased. As illustrated in FIG. 6, the second through holes 53 may be disposed along the axial direction of the mandrel 1. Preferably, the diameter of the second through hole 53 is in a range from 5 mm to 10 mm.

Figure 10A:
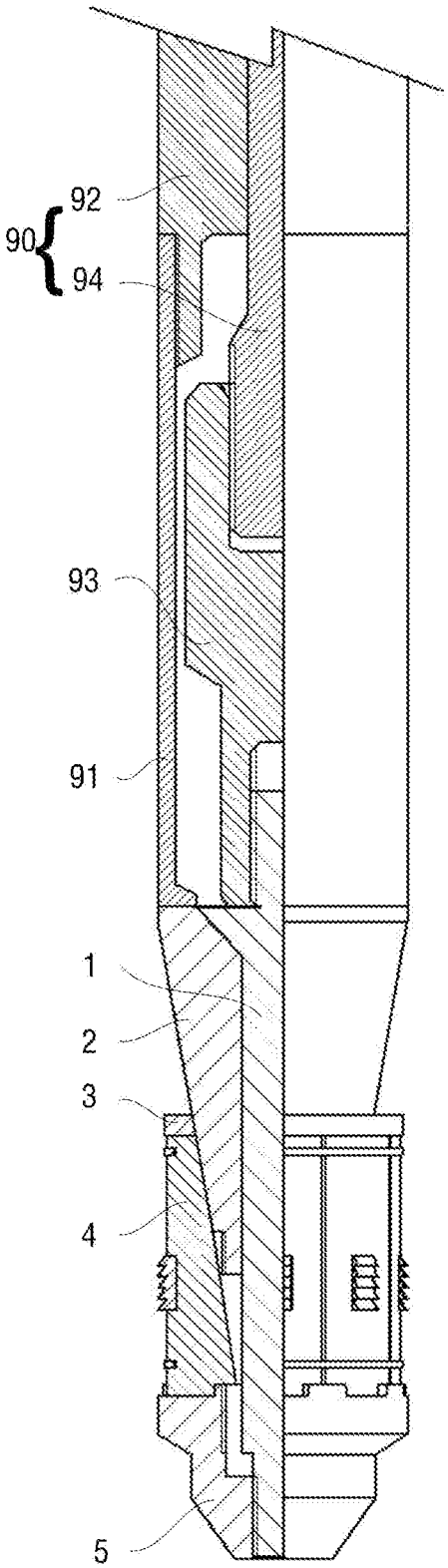
FIG. 10A is a structural schematic diagram of a setting system provided by the present disclosure.
Figure 10B:
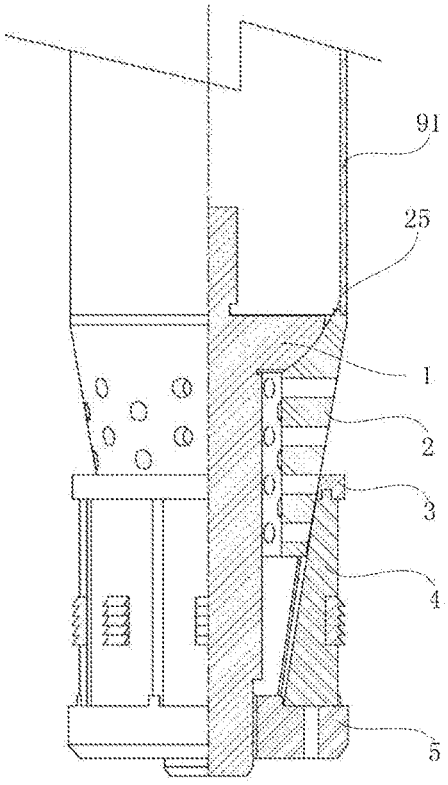
FIG. 10B is a schematic diagram illustrating engagement between an extrusion sleeve in a setting tool and the metal-based dissolvable ball seat provided by the present disclosure.

In one embodiment of the present disclosure, as illustrated in FIG. 10B, the top surface of the sliding body 2 is provided with an annular boss 25 which can mate with an extrusion sleeve 91 in the setting tool 90 to keep coaxiality. The effect is that the metal-based dissolvable ball seat and the setting tool 90 are kept centered without any relative radial movement when they are lowered into the well as an integrity, so as to avoid resistance caused by an eccentric portion touching a joint segment for a casing coupling, and reduce abrasion of the metal-based dissolvable ball seat.

The case where the slip 4 and the sliding body 2 are slidably abutted against each other through the first conical surface structure 60 has been described above.

In the case where the slip 4 and the tail base 5 are slidably abutted against each other through the second conical surface structure 80, the second conical surface structure 80 comprises a second outer conical surface 81 provided on the tail base 5 and a third inner conical surface 82 provided on the slip 4 and matching with the second outer conical surface 81. The second outer conical surface 81 expands gradually from top to bottom. In this case, as illustrated in FIG. 4, the slip 4 and the sliding body 2 can be slidably abutted against each other through the first conical surface structure 60. As illustrated in FIG. 5, the slip 4 and the sliding body 2 may also be slidably abutted against each other through a radially disposed groove structure, which guides the slip 4 to slide along the radial direction of the mandrel 1 relative to the sliding body 2, and prevents the slip 4 from moving upward relative to the sliding body 2. The sliding body 2 pushes the slip 4 to move downward relative to the tail base 5, and the second outer conical surface 81 of the tail base 5 applies an outward pushing force to the third inner conical surface 82 of the slip 4, thereby causing the slip 4 to open up.

In the case where the slip 4 and the tail base 5 are slidably abutted against each other through the second conical surface structure 80, the sealing ring 3 may be disposed below the slip 4. When the slip 4 moves downward, the sealing ring 3 is pushed to move downward on the second outer conical surface 81, and the sealing ring 3 gradually expands outward.

Preferably, as illustrated in FIGS. 4 and 5, the second outer conical surface 81 is a circular conical surface, with a taper angle β in a range from 3° to 7°, and the range of the taper angle β may be the same as that of the taper angle α. For example, β may be 3°, 3.5°, 4°, 4.9°, 5°, 5.1°, 6°, 6.4° or 7°, so that with the self-locking formed by the static friction force, the slip 4 is prevented from sliding along the second outer conical surface 81, thereby effectively alleviating the problem of disengagement in the process of placement into the well. In this embodiment, it is not necessary to provide the shear pins, thereby reducing the difficulty in control and improving the operation stability. The taper angle β may be or may not be equal to the taper angle α.

The present disclosure provides a setting system, comprising a setting tool 90 and the metal-based dissolvable ball seat described above. As illustrated in FIG. 10A, the setting tool 90 comprises a setting tool outer barrel 92 and a setting tool push rod 94 disposed in the setting tool outer barrel 92. The setting tool outer barrel 92 is abutted against the upper end of the sliding body 2 in the metal-based dissolvable ball seat, and applies a downward pushing force to the sliding body 2. The setting tool push rod 94 is connected to the upper end of the mandrel 1 in the metal-based dissolvable ball seat, and applies an upward pulling force to the mandrel 1. Specifically, the setting tools may be Baker #10 or #20 setting tools.

In order to facilitate the connection between the setting tool 90 and the metal-based dissolvable ball seat, a joint structure may be provided between the setting tool outer barrel 92 and the sliding body 2, and between the setting tool push rod 94 and the mandrel 1, respectively.

An extrusion sleeve 91 is disposed between the setting tool outer barrel 92 and the sliding body 2, an upper end of the extrusion sleeve 91 is in threaded connection with the setting tool outer barrel 92, and a lower end of the extrusion sleeve 91 is abutted against the upper end face of the sliding body 2. In one embodiment, as illustrated in FIG. 10B, the lower end of the extrusion sleeve 91 is disposed to sleeve the annular boss 25 on the top surface of the sliding body 2, and the annular boss 25 plays a role in positioning the extrusion sleeve 91 and the sliding body 2.

The setting system further comprises an adapter 93 disposed in the extrusion sleeve 91, a lower end of the adapter 93 is in threaded connection with the upper end of the mandrel 1, and the upper end of the adaptor 93 is in threaded connection with the setting tool push rod 94.

In other words, the setting tool outer barrel 92 is in threaded connection with the extrusion sleeve 91, the setting tool push rod 94 is in threaded connection with the adapter 93, and the adapter 93 is in threaded connection with the mandrel 1.

When the setting system works with the metal-based dissolvable ball seat illustrated in FIG. 1, it can operate in accordance with the following process:

An ignition of propellant provides a pushing force, the setting tool push rod 94 provides an upward pulling force to the mandrel 1 and in turn the tail base 5 through the adapter 93, and the setting tool outer barrel 92 applies a downward pushing force to the sliding body 2 through the extrusion sleeve 91. The pushing force and pulling force applied can overcome the friction force between the sliding body 2 and the slip 4, and the sliding body 2 makes an axial climbing movement along the slip 4. The sealing ring 3 and the slip 4 start to expand simultaneously under the radial force, such that the outer diameter of the sealing ring 3 keeps increasing and starts to contact the wellbore and the slip 4 opens up uniformly in all directions. The sliding body 2 continues moving downward, such that the sealing ring 3 is tightly attached to the inner wall of the wellbore to form a metal sealing, the slip 4 bites into the wellbore tightly to form an anchoring, and the sliding body horse-tooth buckle 22 and the tail base horse-tooth buckle 51 are locked up. After the sliding body 2 moves to the set position, the mandrel 1 is disengaged from the tail base 5 under the upward pulling force. The mandrel 1 is lifted out of the wellbore along with the setting tool push rod 94, and the sliding body 2, the sealing ring 3, the slip 4 and the tail base 5 become an integrity to form a setting ball seat left in the wellbore.

The dissolvable ball is put into the wellbore and seated in the ball seat hole 21 of the sliding body 2, then a fracturing operation is performed. After the fracturing operation, liquid containing electrolyte is injected into the wellbore, and the dissolvable ball and the metal-based dissolvable ball seat are gradually dissolved to form a full-bore.

This setting system is advantageous in achieving segmented packing, multi-cluster fracture initiation, full-bore upgrading and drilling-free production after fracturing, and is excellent in adaptability to processes and in techno-economic efficiency.

Figure 11:
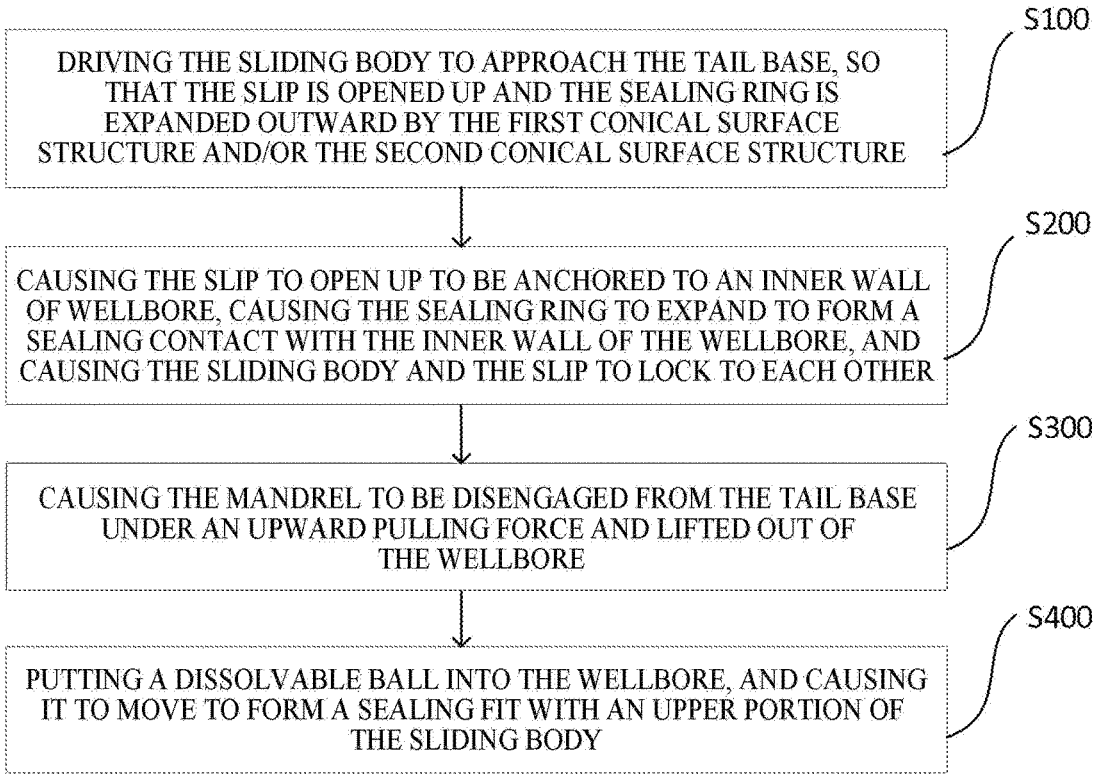
FIG. 11 is a flow chart of a setting method provided by the present disclosure.

The present disclosure provides a setting method working with the metal-based dissolvable ball seat described above. As illustrated in FIG. 11, the setting method comprises the steps of:

S100, driving the sliding body 2 to approach the tail base 5, so that the slip 4 is opened up and the sealing ring 3 is expanded outward by the first conical surface structure 60 and/or the second conical surface structure 80;

S200, causing the slip 4 to open up to be anchored to the inner wall of the wellbore, causing the sealing ring 3 to expand to form a sealing contact with the inner wall of the wellbore, and causing the sliding body 2 and the slip 4 to lock to each other;

S300, causing the mandrel 1 to be disengaged from the tail base 5 under an upward pulling force and lifted out of the wellbore; and S400, putting a dissolvable ball 95 into the wellbore, and causing it to move to form a sealing fit with the upper portion of the sliding body 2.

Specifically, in step S100, the force driving the sliding body to approach the tail base may be provided by the setting tool 90. In step S300, the mandrel 1 may be lifted out of the wellbore along with the setting tool 90.

In one embodiment of the present disclosure, the tail base 5 is in threaded connection with the mandrel 1. In step S300, the disengagement of mandrel 1 from the tail base 5 is achieved by breaking the threaded connection structure between the tail base 5 and the mandrel 1. Specifically, the setting tool 90 applies an upward pulling force to the mandrel 1 and a downward pushing force to the sliding body 2, thereby exerting a shearing force on the threaded connection structure between the tail base 5 and the mandrel 1. When the shearing force reaches a predefined amplitude, the threaded connection structure is broken, therefore the mandrel 1 is disengaged from the tail base 5, and the mandrel 1 can be lifted out of the wellbore along with the setting tool 90.

In order to achieve the relative locking between the sliding body 2 and the slip 4 in step S200, as illustrated in FIGS. 1 and 2, in one embodiment, the lower end of the sliding body 2 is provided with a sliding body horse-tooth buckle 22, and the tail base 5 is provided with a tail base horse-tooth buckle 51 matching with the sliding body horse-tooth buckle 22 to lock the sliding body 2 and the tail base 5. In step S200, the sliding body 2 and the tail base 5 are locked up by engaging the sliding body horse-tooth buckle 22 and the tail base horse-tooth buckle 51, thereby achieving the relative locking between the sliding body 5 and the slip 4. This embodiment may work with the metal-based dissolvable ball seat with the structure illustrated in FIG. 4 or FIG. 5.

Figure 8:
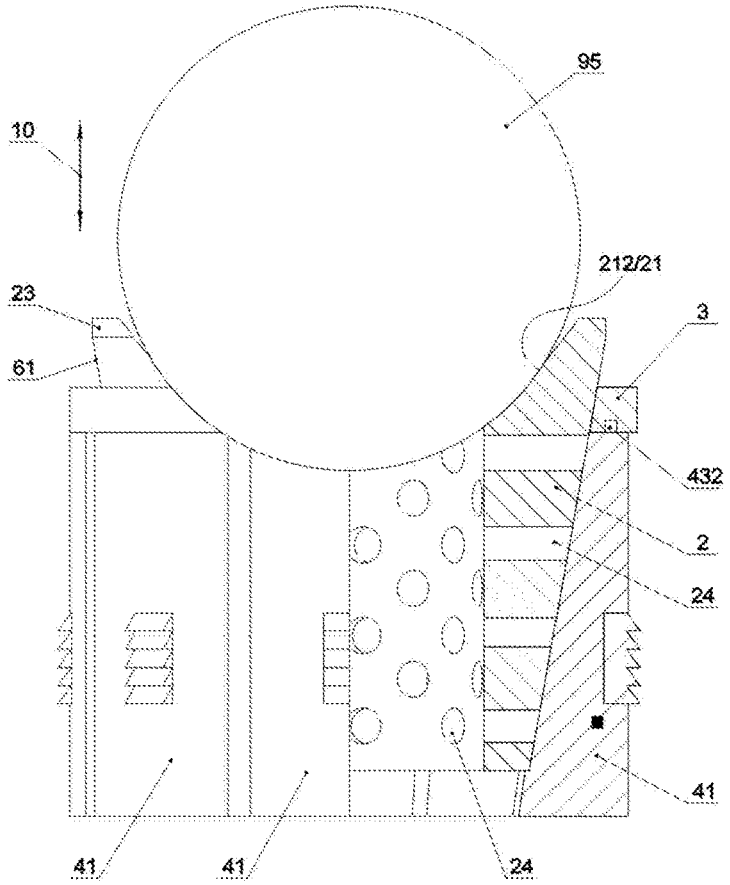
FIG. 8 is a schematic diagram illustrating that the metal-based dissolvable ball seat illustrated in FIG. 6 is fitted with a dissolvable ball after being set.
Figure 9:
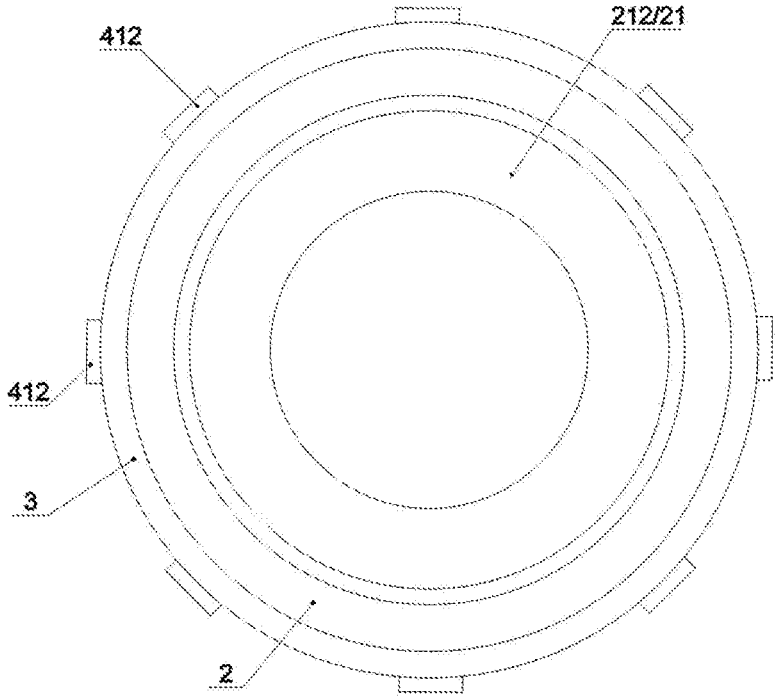
FIG. 9 is a top view of FIG. 8 (the dissolvable ball is omitted)

In another embodiment, as illustrated in FIGS. 6 and 8, the slip 4 and the sliding body 2 are slidably abutted against each other through the first conical surface structure 60. The first conical surface structure 60 comprises a first outer conical surface 61 provided on the sliding body 2 and a first inner conical surface 62 provided on the slip 4 and matching with the first outer conical surface 61. The first outer conical surface 61 is tapered gradually from top to bottom, with a taper angle in a range from 3° to 7°. In step S200, the sliding body 2 and the slip 4 are locked to each other by the friction force between the first outer conical surface 61 and the first inner conical surface 62. In this embodiment, the sliding body horse-tooth buckle 22 and the tail base horse-tooth buckle 51 are omitted in the sliding body 2 and the tail base 5. By setting the taper angle of the first outer conical surface 61 in a range from 3° to 7° (for example, the taper angle α of the first outer conical surface 61 may be 3°, 3.5°, 4°, 4.9°, 5°, 5.1°, 6°, 6.4° or) 7°, an sufficient static friction force can be generated between the sliding body 2 and the slip 4 when the sliding body 2 and the slip 4 move in place relative to each other, which can prevent the sliding body 2 from moving upward or downward relative to the slip 4 under the external force such as a liquid flow, so that the sliding body 2 and the slip 4 are self-locked by friction. When the mandrel 1 is disengaged from the tail base 5 and the release is successful, the mandrel 1 is taken out from the sliding body 2 with the setting tool 90, then the tail base 5 can be disengaged from the slip 4 and fall freely to bottom of a vertical well, or move to bottom of a horizontal well due to the liquid flow and dissolve quickly. At this time, a minimum inner diameter of the metal-based dissolvable ball seat is the inner diameter of the sliding body 2, thus the inner diameter of the metal-based dissolvable ball seat is effectively increased.

The teachings of all patents, published applications and references cited herein are incorporated by reference in their entirety.

Those described above are only a few embodiments of the present disclosure, and persons skilled in the art can make various modifications or variations to the embodiments of the present disclosure according to the contents disclosed in the application document without departing from the spirit and scope of the present disclosure. It will be understood by those skilled in the art that various changes in form and details may be made therein without departing from the scope of the embodiments encompassed by the appended claims.

What is claimed is:

1. A metal-based dissolvable ball seat, comprising a mandrel, a tail base, a sliding body, a slip and a sealing ring, wherein the tail base is coupled to a lower end of the mandrel so that the mandrel can be disengaged from the tail base under a predefined shearing force, the sliding body is disposed to sleeve the mandrel and located above the tail base;

the slip is disposed outside the mandrel and between the tail base and the sliding body, and the slip is slidably abutted against the tail base and the sliding body respectively;

the slip and the sliding body are slidably abutted against each other through a first conical surface structure, and/or the slip and the tail base are slidably abutted against each other through a second conical surface structure;

the sealing ring is coupled to the slip, and is able to move along an axial direction of the mandrel together with the slip, the metal-based dissolvable ball seat is configured so that when the sliding body and the tail base are approaching each other, the slip is opened up and the sealing ring is expanded outward; and that when the sliding body and the tail base are close to each other to a predefined position, the sliding body and the slip are locked to each other, wherein a substrate of the slip, the sliding body and the tail base are all made of dissolvable metal materials, and wherein the dissolution rates of the tail base, the sliding body, a substrate of the slip and the sealing ring descend in sequence.

2. The metal-based dissolvable ball seat according to claim 1, wherein the first conical surface structure comprises a first outer conical surface provided on the sliding body and a first inner conical surface provided on the slip and matching with the first outer conical surface, the first outer conical surface being tapered from top to bottom.

3. The metal-based dissolvable ball seat according to claim 2, wherein the first outer conical surface is a circular conical surface.

4. The metal-based dissolvable ball seat according to claim 2, wherein a taper angle of the first outer conical surface is in a range from 3° to 7°.

5. The metal-based dissolvable ball seat according to claim 4, wherein the taper angle of the first outer conical surface is one of 3°, 3.5°, 4°, 4.9°, 5°, 5.1°, 6°, 6.4° or 7°.

6. The metal-based dissolvable ball seat according to claim 2, wherein the slip and the tail base are slidably abutted against each other through a guide groove structure, which comprises a guide groove provided on the tail base and extended from inside to outside and a guide protrusion provided on the slip and matching with the guide groove.

7. The metal-based dissolvable ball seat according to claim 6, wherein the guide groove extends in a radial direction of the mandrel.

8. The metal-based dissolvable ball seat according to claim 6, wherein a cross section of the guide groove is rectangular.

9. The metal-based dissolvable ball seat according to claim 2, wherein the sealing ring is disposed above the slip, and the sealing ring is provided with a second inner conical surface matching with the first outer conical surface.

10. The metal-based dissolvable ball seat according to claim 9, wherein the sealing ring is made of a dissolvable metal material.

11. The metal-based dissolvable ball seat according to claim 10, wherein the sealing ring is made of a magnesium-aluminum alloy or a lithium-magnesium alloy.

12. The metal-based dissolvable ball seat according to claim 1, wherein the slip comprises a plurality of slip petals distributed circumferentially around an axis of the mandrel.

13. The metal-based dissolvable ball seat according to claim 12, wherein each of the slip petals comprises a substrate, and a slip block fixed to the substrate for engaging with a wellbore.

14. The metal-based dissolvable ball seat according to claim 12, wherein the number of the slip petals is in a range from 6 to 8.

15. The metal-based dissolvable ball seat according to claim 12, wherein the slip comprises at least one hoop hooping the slip petals.

16. The metal-based dissolvable ball seat according to claim 12, wherein at least one columnar pin is provided on the slip petal, a columnar hole matching with the columnar pin is provided on the sealing ring, and the columnar pin is accommodated in the columnar hole.

17. The metal-based dissolvable ball seat according to claim 1, wherein the tail base is in threaded connection with the mandrel.

18. The metal-based dissolvable ball seat according to claim 1, wherein a lower end of the sliding body is provided with a sliding body horse-tooth buckle, and the tail base is provided with a tail base horse-tooth buckle matching with the sliding body horse-tooth buckle to lock the sliding body and the tail base.

19. The metal-based dissolvable ball seat according to claim 1, wherein an upper portion of the sliding body is provided with a cylindrical portion.

20. The metal-based dissolvable ball seat according to claim 1, wherein when the metal-based dissolvable ball seat is placed into a well, a maximum outer diameter of the sliding body is larger than that of the sealing ring, and/or a maximum outer diameter of the tail base is larger than that of the sealing ring.

21. The metal-based dissolvable ball seat according to claim 1, wherein an upper portion of the sliding body is provided with a ball seat hole, which is a conical ball seat hole tapered from top to bottom.

22. The metal-based dissolvable ball seat according to claim 1, wherein an upper portion of the sliding body is provided with a ball seat hole, which is a spherical crown-shaped ball seat hole.

23. The metal-based dissolvable ball seat according to claim 1, wherein the sliding body is provided with a plurality of first through holes.

24. The metal-based dissolvable ball seat according to claim 23, wherein a diameter of the first through hole is in a range from 5 mm to 10 mm.

25. The metal-based dissolvable ball seat according to claim 1, wherein the tail base is provided with a plurality of second through holes.

26. The metal-based dissolvable ball seat according to claim 25, wherein a diameter of the second through hole is in a range from 5 mm to 10 mm.

27. The metal-based dissolvable ball seat according to claim 1, wherein the second conical surface structure comprises a second outer conical surface provided on the tail base, and a third inner conical surface provided on the slip and matching with the second outer conical surface, the second outer conical surface expands gradually from top to bottom.

28. The metal-based dissolvable ball seat according to claim 27, wherein the second outer conical surface is a circular conical surface, and a taper angle of the second outer conical surface is in a range from 3° to 7°.

29. The metal-based dissolvable ball seat according to claim 1, wherein a top surface of the sliding body is provided with an annular boss.

30. A system for setting a downhole equipment, comprising a setting tool and the metal-based dissolvable ball seat according to claim 1, wherein the setting tool comprises a setting tool outer barrel abutted against an upper end of a sliding body in the metal-based dissolvable ball seat, and a setting tool push rod connected to an upper end of a mandrel in the metal-based dissolvable ball seat, the setting tool outer barrel is configured to apply a downward pushing force to the sliding body, and the setting tool push rod is configured to apply an upward pulling force to the mandrel.

31. The system according to claim 30, further comprising an extrusion sleeve which is disposed between the setting tool outer barrel and the sliding body, and which has an upper end in threaded connection with the setting tool outer barrel and a lower end abutted against an upper end face of the sliding body.

32. The system according to claim 31, further comprising an adapter which is disposed in the extrusion sleeve, and which has a lower end in threaded connection with an upper end of the mandrel and an upper end in threaded connection with the setting tool push rod.

33. A method for setting a downhole equipment working with the metal-based dissolvable ball seat according to claim 1, comprising steps of:

S100, driving the sliding body to approach the tail base, so that the slip is opened up and the sealing ring is expanded outward by the first conical surface structure and/or the second conical surface structure;

S200, causing the slip to open up to be anchored to an inner wall of a wellbore, causing the sealing ring to expand to form a sealing contact with the inner wall of the wellbore, and causing the sliding body and the slip to lock to each other;

S300, causing the mandrel to be disengaged from the tail base under an upward pulling force and lifted out of the wellbore; and S400, putting a dissolvable ball into the wellbore, and causing the dissolvable ball to move to form a sealing fit with an upper portion of the sliding body, wherein the method further comprises selecting dissolvable metal materials with different dissolution rates for the tail base, the sliding body, a substrate of the slip and the sealing ring so that the dissolution rates of the tail base, the sliding body, the substrate of the slip and the sealing ring descend in sequence.

34. The method according to claim 33, wherein a lower end of the sliding body is provided with a sliding body horse-tooth buckle, and the tail base is provided with a tail base horse-tooth buckle matching with the sliding body horse-tooth buckle to lock the sliding body and the tail base; and in step S200, the sliding body and the tail base are locked by engaging the sliding body horse-tooth buckle and the tail base horse-tooth buckle, so as to lock the sliding body and the slip to each other.

35. The method according to claim 33, wherein the slip and the sliding body are slidably abutted against each other through a first conical surface structure, which comprises a first outer conical surface provided on the sliding body, and a first inner conical surface provided on the slip and matching with the first outer conical surface, the first outer conical surface being tapered from top to bottom;

a taper angle of the first outer conical surface is in a range from 3° to 7°; and in step S200, the sliding body and the slip are locked to each other by a friction force between the first outer conical surface and the first inner conical surface.

36. The method according to claim 33, wherein the tail base is in threaded connection with the mandrel; and in step S300, the mandrel is disengaged from the tail base by breaking a threaded connection structure between the tail base and the mandrel.

* * * * *